US011217263B2

(12) United States Patent
Kanamori et al.

(10) Patent No.: US 11,217,263 B2
(45) Date of Patent: Jan. 4, 2022

(54) SOUND COLLECTION DEVICE, MOVING BODY, AND SOUND COLLECTION METHOD

(71) Applicant: Yamaha Corporation, Shizuoka (JP)

(72) Inventors: Kohei Kanamori, Shizuoka (JP); Satoshi Ukai, Sudbury, MA (US)

(73) Assignee: YAMAHA CORPORATION, Shizuoka (JP)

( * ) Notice: Subject to any disclaimer, the term of this patent is extended or adjusted under 35 U.S.C. 154(b) by 64 days.

(21) Appl. No.: 16/738,893

(22) Filed: Jan. 9, 2020

(65) Prior Publication Data

US 2020/0152221 A1 May 14, 2020

Related U.S. Application Data

(63) Continuation of application No. PCT/JP2017/025536, filed on Jul. 13, 2017.

(51) Int. Cl.
*G10L 21/0232* (2013.01)
*G10L 25/51* (2013.01)

(52) U.S. Cl.
CPC ..... *G10L 21/0232* (2013.01); *G10L 25/51* (2013.01)

(58) Field of Classification Search
CPC ..... G10L 25/51; G10L 21/0232
USPC ..... 381/56
See application file for complete search history.

(56) References Cited

U.S. PATENT DOCUMENTS 9,442,496 B1 9/2016 Beckman et al.
2016/0063987 A1 3/2016 Xu et al.
2016/0083073 A1 3/2016 Beckman
2016/0379619 A1 12/2016 Sugaya
2017/0154618 A1* 6/2017 Beckman ..... G05D 19/02

FOREIGN PATENT DOCUMENTS

JP 2006-323172 A 11/2006
JP 2008-020872 A 1/2008
JP 2008153743 A 7/2008
JP 2010-055969 A 3/2010
JP 2011-077604 A 4/2011
JP 2012-074762 A 4/2012
JP 2015-104091 A 6/2015
(Continued)

OTHER PUBLICATIONS

International Search Report in PCT/JP2017/025536, dated Sep. 12, 2017.

(Continued)

*Primary Examiner* — Paul Kim

(74) *Attorney, Agent, or Firm* — Global IP Counselors, LLP

(57) ABSTRACT

A sound collection device includes a sensor, a database, a microphone, and an electronic controller. The sensor detects a state of at least one of the sound collection device or a device equipped with the sound collection device, or both. The database is a database of noise sounds. The electronic controller includes a signal processing unit configured to read at least one noise sound from the database based on a detection value of the sensor and carry out a noise reduction process to reduce noise from a sound signal acquired by the microphone based on the at least one noise sound read from the database.

22 Claims, 4 Drawing Sheets

(56) References Cited

FOREIGN PATENT DOCUMENTS

| | | | |
|---|---|---|---|
| JP | 2017-502568 | A | 1/2017 |
| JP | 2017009965 | A | 1/2017 |

OTHER PUBLICATIONS

Translation of Office Action in the corresponding Japanese Patent Application No. 2019-529390, dated Mar. 2, 2021.
An Office Action in the corresponding Japanese Patent Application No. 2019-529390, dated Jun. 2, 2021.

* cited by examiner

| ROTATIONAL SPEED | ANGULAR ACCELERATION Sp | ANGULAR ACCELERATION Sy | · · · | VELOCITY Vz | NOISE SOUND |
|---|---|---|---|---|---|
| ⋮ | | | | | |
| 100 | 0 | 0 | | 0 | |
| 200 | 0 | 0 | | 0 | |
| 300 | 0 | 0 | | 0 | |
| 400 | 0 | 0 | | 0 | |

SOUND COLLECTION DEVICE, MOVING BODY, AND SOUND COLLECTION METHOD

CROSS-REFERENCE TO RELATED APPLICATIONS

This application is a continuation application of International Application No. PCT/JP2017/025536, filed on Jul. 13, 2017. The entire disclosure of International Application No. PCT/JP2017/025536 is hereby incorporated herein by reference.

BACKGROUND

Technological Field

One embodiment of the present invention relates to a sound collection device, a moving body, and a sound collection method for reducing noise sounds from sound acquired with a microphone.

Background Information

U.S. Patent Application Publication No. 2016/0083073 discloses a configuration for canceling noise sounds by rotating two propellers in opposite directions and physically generating sounds of opposite phase.

Japanese Laid-Open Patent Application No. 2015-104091 discloses a configuration for reducing wind noise sound by means of gain control in accordance with the level of the wind noise sound.

The configuration of U.S. Patent Application Publication No. 2016/0083073 has a hardware limitation in which two propellers are rotated in synchronization. In the configuration of U.S. Patent Application Publication No. 2016/0083073, the target sound to be acquired with the microphone is also reduced.

SUMMARY

Therefore, the object of one embodiment of this disclosure is to provide a sound collection device, a moving body, and a sound collection method that reduce noise sounds that change due to a movement of the device itself in the moving body.

The sound collection device comprises a sensor, a database, a microphone, and an electronic controller. The sensor is configured to detect a state of at least one of the sound collection device or a device equipped with the sound collection device, or both. The database is a database of noise sounds. The electronic controller includes a signal processing unit configured to read a noise sound from the database based on a detection value that the sensor detects, and carry out a noise reduction process to reduce noise from a sound signal acquired by the microphone based on the at least one noise sound read from the database.

DETAILED DESCRIPTION OF THE EMBODIMENTS

Selected embodiments will now be explained with reference to the drawings. It will be apparent to those skilled in the field from this disclosure that the following descriptions of the embodiments are provided for illustration only and not for the purpose of limiting the invention as defined by the appended claims and their equivalents.

The sound collection device according to the present embodiment comprises a sensor, a database, a microphone, and a signal processing unit. The sensor detects a state of a device in which the sensor is disposed. The database is a database of noise sounds. The signal processing unit reads a noise sound from the database based on a detection value of the sensor, and carries out a process to reduce noise from the sound of the microphone based on the read noise sound.

Since the sound collection device reduces noise sounds by means of signal processing, there is no hardware limitation as in the configuration of U.S. Patent Application Publication No. 2016/0083073 (Specification). In addition, because the sound collection device reads a noise sound from the database and carries out a process to reduce noise from the sound acquired by the microphone based on the read noise sound, it is not a simple level control process as in the configuration of Japanese Laid-Open Patent Application No. 2015-104091, and the target sound to be acquired with the microphone is not reduced.

Figure 1:
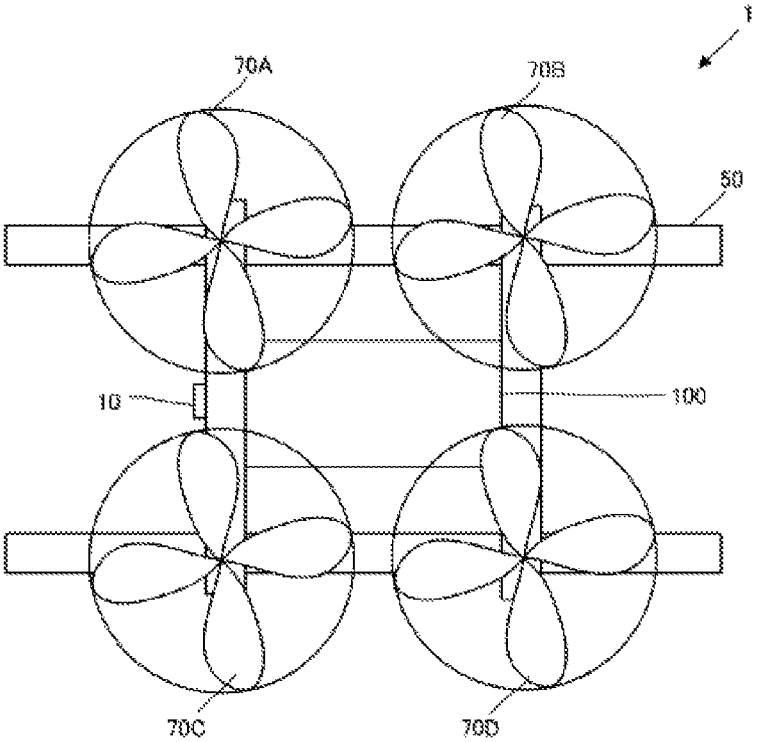
FIG. 1 is a plan view showing a configuration of the moving body.
Figures 4, 5:
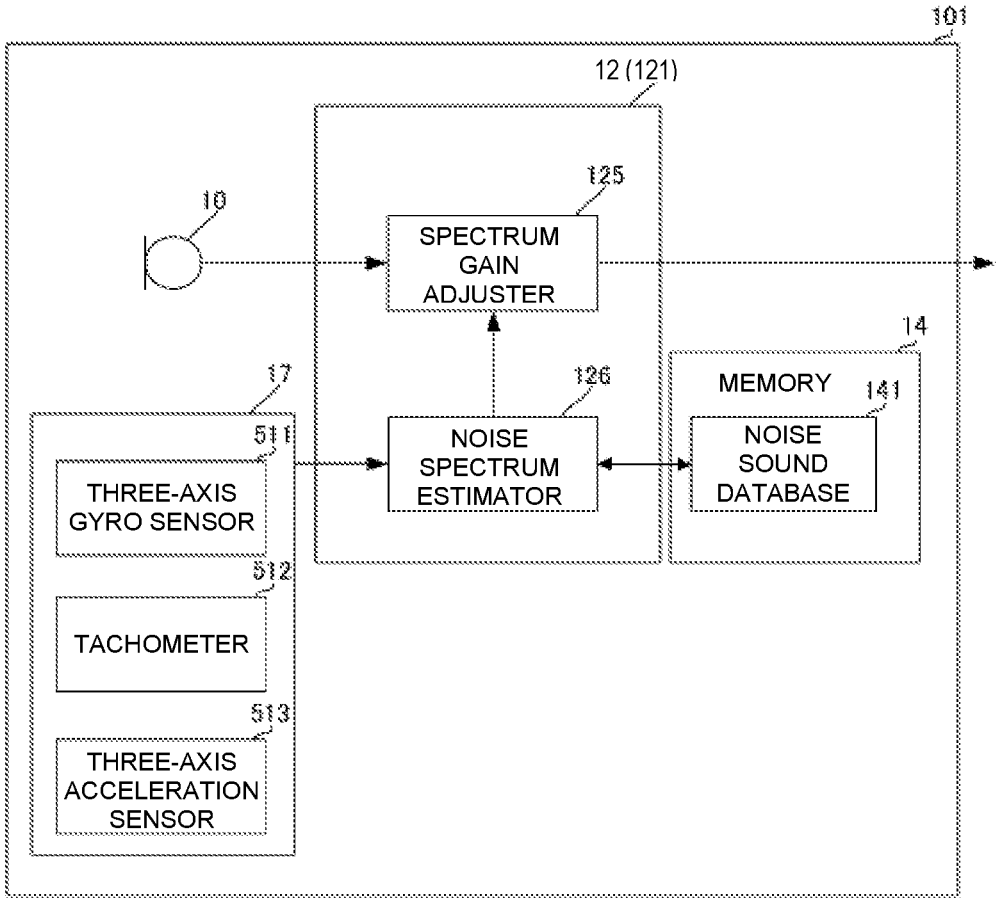
FIG. 4 is a block diagram showing a functional configuration of the sound collection device.
FIG. 5 is a view showing one example of the database.

FIG. 1 is an external plan view that shows the configuration of a moving body 1 comprising the sound collection device 101 (FIG. 4). The moving body 1 comprises a housing 50, and a plurality (four, in this example) of propellers 70A, 70B, 70C, 70D, a microphone 10, and a control circuit board 100, which are provided in the housing 50. The number of the plurality of propellers is not limited to four, and can be one or more.

The housing 50 is formed by combining a plurality of columnar members. The shape of the housing 50 shown in FIG. 1 is merely an example, and any shape can be used. The propellers 70A, 70B, 70C, 70D are placed on the upper surface of the housing 50.

In addition, the control circuit board 100 and the microphone 10 are fixed to the housing 50. The microphone 10 is fixed to a side surface of the housing 50.

Figure 2:
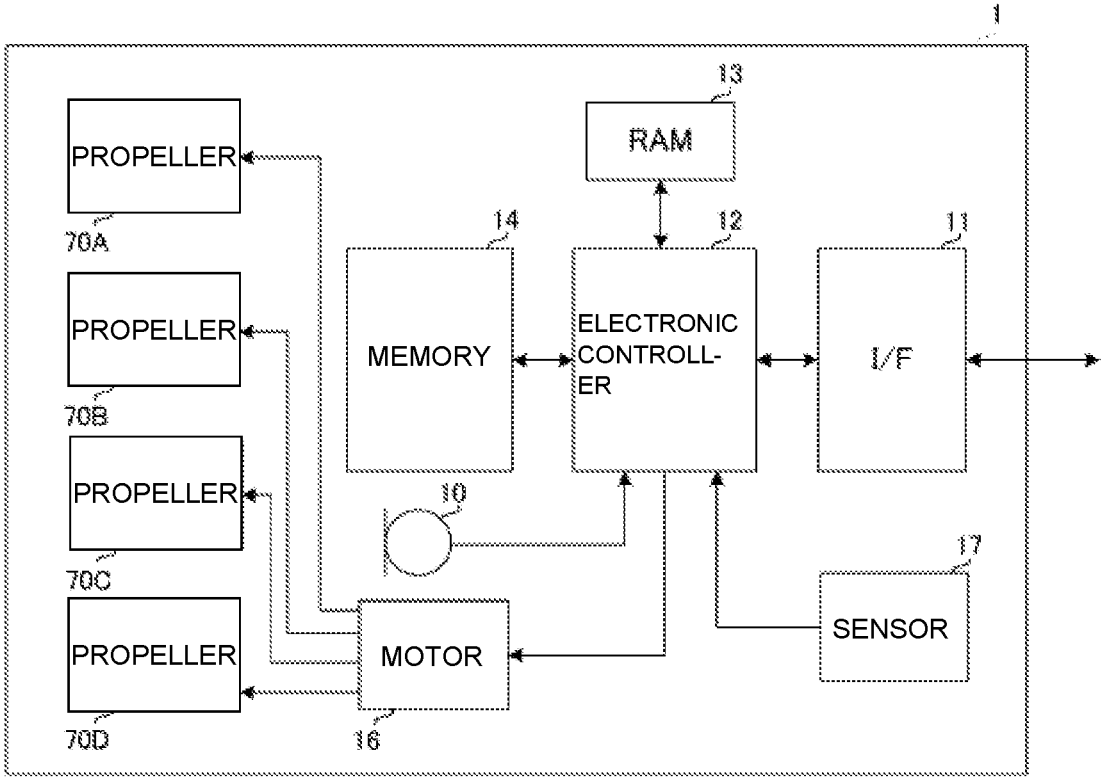
FIG. 2 is a block diagram showing a hardware configuration of the moving body.

FIG. 2 is a block diagram that shows the hardware configuration of the moving body 1. The moving body 1 comprises the microphone 10, an interface (I/F) 11 (wireless communicator), an electronic controller 12, a RAM 13, a memory 14, a motor 16, a sensor 17, and propellers 70A, 70B, 70C, 70D. The moving body 1 also has other hardware, such as a camera, but illustrations and descriptions thereof are omitted in the present embodiment.

The control circuit board 100 has various hardware, including the I/F 11, the electronic controller 12, the RAM 13, the memory 14, and the sensor 17.

Figure 3:
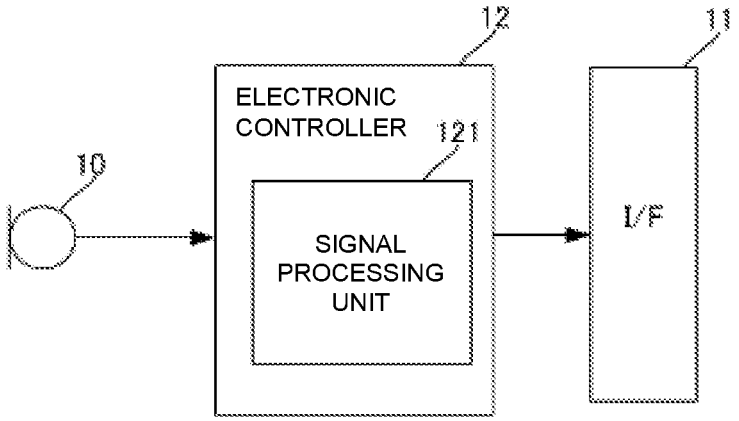
FIG. 3 is a block diagram showing a configuration example of the signal processing unit.

The term "electronic controller" as used herein refers to hardware that executes software programs. The electronic controller 12 includes a processing device such as a CPU (Central Processing Unit) having at least one processor that controls the overall operation of the moving body 1. The electronic controller 12 further can include a dedicated signal processor (DSP: Digital Signal Processor), and in this case, the DSP performs signal processing in accordance with an instruction from the CPU. The electronic controller 12 reads a program from the memory 14, which is a storage medium, and temporarily stores the read program in the RAM 13 to perform various operations. For example, the electronic controller 12 functions as a control unit that controls the rotational speed of the motor 16. In addition, as shown in FIG. 3, the electronic controller 12 constitutes a signal processing unit 121.

The memory 14 is any computer readable medium with the sole exception of a transitory, propagating signal. The memory 14 can include nonvolatile memory and volatile memory. The memory 14 is composed of a flash memory, for example. Any known well-known storage medium, such as a magnetic storage medium or a semiconductor storage medium, or a combination of a plurality of types of storage media can be freely employed as the memory 14. The memory 14 stores the program to operate the electronic controller 12, as described above. In addition, as shown in FIG. 4, the memory 14 also stores a noise sound database 141.

The microphone 10 acquires the sound around the moving body 1. The microphone 10 outputs a sound signal corresponding to the acquired sound to the electronic controller 12. The signal processing unit 121 of the electronic controller 12 applies signal processing to the sound signal that is input from the microphone 10 and outputs the processed signal (sound obtained by applying a noise reduction process) to the I/F 11.

The I/F 11 outputs the sound signal input from the electronic controller 12. The I/F 11 has a built-in wireless communication function, for example. The I/F 11 includes a wireless communicator as said wireless communication function to transmit the sound signal (sound obtained by applying the noise reduction process) to a controller (for example, an information processing device such as a smartphone) of the moving body 1.

FIG. 4 is a block diagram that shows the functional configuration of the sound collection device 101. The microphone 10, the electronic controller 12 (signal processing unit 121), the sensor 17, and the memory 14 constitute the sound collection device 101.

The signal processing unit 121 reads at least one noise sound from the noise sound database 141 based on a detection value that the sensor 17 detects, and carries out a noise reduction process to reduce noise from a sound signal acquired by the microphone 10 based on the at least one noise sound read from the noise sound database 141. The signal processing unit 121 adjusts a frequency gain based on a frequency characteristic of the at least one noise sound read from the noise sound database 141. The signal processing unit 121 includes a spectral gain regulator 125 and a noise spectrum estimator 126. In this example, the signal processing unit 121 carries out the noise sound reduction process using the spectrum subtraction method with the spectral gain regulator 125.

The spectral gain regulator 125 carries out the noise reduction process using the spectrum subtraction method, for example, indicated by the following formula.

$$Y(f)=G(f)\cdot X(f)$$

$$G(f)=1-|N(f)|/X(f)|$$

Here, X(f) is the input signal (frequency signal) and Y(f) is the output signal (frequency signal). N(f) is the noise spectrum. The noise spectrum estimator 126 estimates said noise spectrum N(f). The spectral gain regulator 125 uses the noise spectrum N(f) estimated by the noise spectrum estimator 126 to calculate the spectral gain G(f).

The noise spectrum estimator 126 uses the detection value of the sensor 17 to read the corresponding noise spectrum from the noise sound database 141 in the memory 14. The sensor 17 detects a state of at least one of the sound collection device 101 or a device equipped with the sound collection device 101, or both. In the present embodiment, the device is the moving body 1. The sensor 17 includes, for example, a three-axis gyro sensor 511, a tachometer 512, and a three-axis acceleration sensor 513. The three-axis gyro sensor 511 detects the angular velocities (angular velocity Sp, angular velocity Sy, and angular velocity Sr) for the three axes of the moving body 1: pitch, yaw, and roll.

The sensor 17 can also calculate the three-axis angular accelerations (angular acceleration Rp, angular acceleration Ry, and angular acceleration Rr) from the angular velocities detected by the three-axis gyro sensor 511. Moreover, the sensor 17 can also calculate the orientations (orientation P, orientation Y, and orientation R) of the moving body 1 from the calculated angular accelerations. The orientation is represented by the angle of each axis (pitch, yaw, and roll) with the horizontally placed state as the origin. In this case, the three-axis gyro sensor 511 is one example of an orientation sensor.

The tachometer 512 detects a rotational speed of a rotating body (detection target of the tachometer 512) of the moving body 1. In the embodiment, the tachometer 512 detects the rotational speed of each of the propellers 70A, 70B, 70C, 70D.

The three-axis acceleration sensor 513 detects the three-axis accelerations (acceleration Ax, acceleration Ay, and acceleration Az) of the moving body 1 in an orthogonal coordinate system. The sensor 17 can also calculate the three-axis velocities (velocity Vx, velocity Vy, and velocity Vz) of the moving body 1 from the accelerations detected by the three-axis acceleration sensor 513.

The sensor 17 detects the detection value, which includes at least one or more of rotational speed, angular velocity, angular acceleration, orientation, acceleration, or velocity. In the embodiment, as described above, the sensor 17 obtains 16-dimensional detection values for the moving body 1. More specifically, the sensor 17 obtains the 16-dimensional detection values, which are rotational speed, angular velocity Sp, angular velocity Sy, angular velocity Sr, angular acceleration Rp, angular acceleration Ry, angular acceleration Rr, orientation P, orientation Y, orientation R, acceleration Ax, acceleration Ay, acceleration Az, velocity Vx, velocity Vy, and velocity Vz, for one propeller. Since there are four propellers in the present embodiment, the sensor 17 obtains a maximum of 64-dimensional detection values. The values other than the rotational speed do not vary greatly for each propeller. Thus, common values for all propellers can be used for parameters other than the rotational speed. In this case, the sensor 17 is configured to obtain a maximum of 19-dimensional detection values.

FIG. 5 is a view showing the noise sound database 141. The noise sound database 141 shown in FIG. 5 is one example of the database according to the present embodiment. The individual noise spectrum for each detection value of the sensor 17 is stored in the noise sound database 141. In FIG. 5, the database is shown in the form of a table for the purpose of explanation, but in practice, a separate noise spectrum is stored for each of the vectors corresponding to the 16-dimensional detection values.

The noise spectra are recorded and acquired in advance using the microphone 10 in a reference environment such as a lab (a state in which only the noise sound of the propeller can be acquired with the microphone 10).

Figure 6:
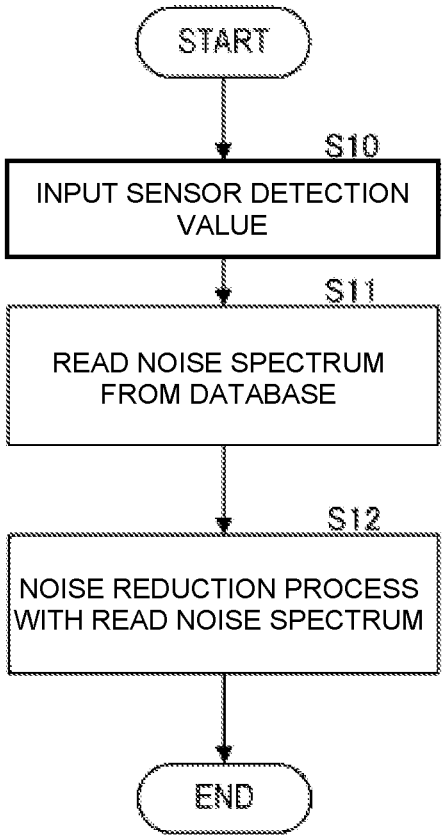
FIG. 6 is a flowchart showing an operation of the sound collection device.

FIG. 6 is a flowchart that shows the operation of the sound collection device 101. First, the sensor 17 of the sound collection device 101 acquires the 16-dimensional detected values described above and inputs the values to the noise spectrum estimator 126 (S10). The noise spectrum estimator 126 refers to the noise sound database 141 with the detection values of the sensor 17 and reads the corresponding noise spectrum (S11). The spectral gain regulator 125 inputs the noise spectrum from the noise spectrum estimator 126 and uses the spectrum subtraction method to carry out the noise reduction process (S12). Then, the sound obtained by applying the noise reduction process to the sound signal acquired by the microphone 10 based on the noise spectrum (noise sound) read from noise sound database 141 is transmitted via the I/F 11.

In this manner, the sound collection device 101 of the present embodiment estimates the noise sound used for the spectral subtraction method from a pre-recorded noise spectrum rather than from the input signal. In general, during sound collection, the target sound to be collected and noise sound other than the target sound are collected. In particular, when sound is picked up by a moving body, there are many cases in which the noise sound that is generated from the moving body is loud, so that it is difficult to extract only the target sound from the collected sound. The noise spectra stored in the noise sound database in the present embodiment are individually recorded according to the state of the moving body 1, which is the cause of the noise sound. Therefore, the noise spectrum estimator 126 can estimate the noise sound with extremely high accuracy by reading the noise spectrum from the noise sound database using the detection values of various sensors. In addition, the signal processing unit 121 can estimate the appropriate noise spectrum corresponding to the current state of the moving body without requiring the use of various complex noise estimation algorithms, so that it is possible to greatly reduce the processing load. Thus, the signal processing unit 121 can carry out the noise reduction process highly accurately and at high speed (in real time). In particular, in the present embodiment, the noise sound that is reduced is primarily the noise sound that is generated by the propellers (the rotating body, which is the detection target of the tachometer). This type of noise sound is not a sudden noise but sound that is continuously generated in accordance with the rotational speed. The spectral subtraction method is suitable for removing this type of continuously generated noise sound.

However, the noise reduction process of the present embodiment is not limited to the spectral subtraction method. There are other processes; for example, the band-pass filter (BPF) process, which removes a band of noise, is another example of the noise reduction process of the present embodiment. When a BPF process is executed, information is stored in the database that indicates the main noise band which is to be band-limited by means of the BPF.

The noise sound database 141 can store the respective noise spectra for the minimum resolution values of all the sensors. In this case, the noise spectrum estimator 126 reads the noise spectrum that matches the detection value of the sensor 17 from the noise sound database 141. However, the amount of data can be reduced in the case of rotational speed, for example, by storing the noise spectra corresponding to every 100 rotations. In this case, when the signal processing unit 121 (noise spectrum estimator 126) determines that a noise sound (noise spectrum) that matches the detection value of the sensor 17 is not present in the noise sound database 141, the signal processing unit 121 (noise spectrum estimator 126) reads a noise sound that is closest to the detection value among the noise sounds of the noise sound database 141. More specifically, the noise spectrum estimator 126 reads the noise spectrum closest to the detection value of the sensor 17 (for example, the closest rotational speed).

Figure 7:
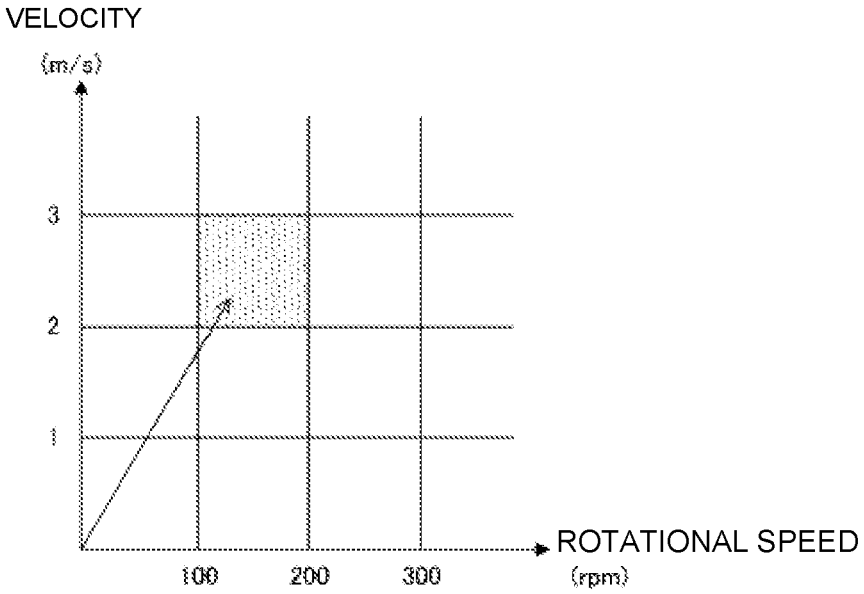
FIG. 7 is a view showing one example of the database

In addition, as shown in FIG. 7, the noise sound database 141 can define the region to which the detection value of each sensor belongs and the corresponding noise spectrum. For example, if the rotational speed is 120 rpm and the velocity is 2.2 m/s, the noise spectrum estimator 126 reads the noise spectrum associated with the region in which the rotational speed is 100-200 rpm and the velocity is 2-3 m/s. In addition, the noise sound database 141 can define, for example, a Voronoi region in which the detection value of a sensor when the plurality of noise spectra are recorded is the generating point. As a result, the noise spectrum estimator 126 can read the noise spectrum that is closest to the detection value of the sensor.

Alternatively, when the signal processing unit 121 (noise spectrum estimator 126) determines that a noise sound (noise spectrum) that matches the detection value of the sensor 17 is not present in the noise sound database 141, the signal processing unit 121 (noise spectrum estimator 126) reads at least two noise sounds from the noise sound database 141, and obtain a noise sound to be used for the noise reduction process based on the at least two noise sounds. More specifically, the noise spectrum estimator 126 can read a plurality of noise spectra that are close to the detection value of the sensor 17 and obtain the noise sound to be used for the noise reduction process. For example, when the rotational speed is 150 rpm, the noise spectrum estimator 126 reads the noise spectra for 100 rpm and 200 rpm which are closest above and below to 150 rpm from the noise sound database 141 as illustrated in FIG. 5. The noise spectrum estimator 126 averages the noise spectra for 100 rpm and 200 rpm and obtains the noise spectrum corresponding to 150 rpm. In this manner, the noise spectrum estimator 126 can read a plurality of noise spectra and interpolate the noise spectrum that corresponds to the sensor detection value. The number of the plurality of noise spectra read by the noise spectrum estimator 126 is not limited to two, and can be three or more.

In addition, there is no need to store the noise vectors corresponding to all of the sensors in the noise sound database 141. For example, regarding one or a plurality of sensors that greatly influence changes in the noise sound, the respective noise spectra corresponding to a plurality of detection values are stored. In regard to the other sensors, it is sufficient if the noise spectrum corresponding to one detection value is stored. Alternatively, in regard to the other sensors, the average value of the noise spectra corresponding to the plurality of detection values can be stored.

According to the embodiment, it is possible to reduce the noise sounds that change due to the movement of a device in which the sensor is disposed.

The description above of the present embodiment pertains to an example in all respects and should not be considered restrictive. The scope of the present embodiment is indicated by the Claims section, not the embodiment described above. Furthermore, the scope of the present embodiment includes the scope that is equivalent that of the Claims.

For example, an anemometer (wind velocity sensor) can solely or additionally be provided as the sensor 17. The anemometer detects wind velocity around the device such as the moving body 1. In this case, the sound collection device 101 performs a process to reduce wind noise. The sound collection device 101 includes a database of noise sounds corresponding to the detection values of the anemometer. For example, since the wind noise sound changes in accordance with changes in wind velocity, the database records a noise spectrum for each wind velocity value. The sound collection device 121 reads the noise sound corresponding to the current wind velocity from the pre-recorded noise spectra and carries out the noise reduction process using the read noise sound.

In addition, in the present embodiment, the moving body 1 comprising propellers was described as an example, but the sound collection device 101 of the present embodiment can use, for example, another moving body (for example, an automobile). In this case, the sound collection device 101 realizes a hands-free phone used inside an automobile. The sound collection device 101 carries out a process to reduce various noise sounds generated while the automobile is running. The various noise sounds are, for example, road noise, wind noise, engine noise, and the like. The sensor 17 includes at least one or more of a vehicle speed sensor, a yaw rate sensor, a pitch sensor, an acceleration sensor, an engine rotational speed detector, a tire rotational speed detector, a window open/close detection sensor, or the like. The rotating body is an engine, a motor, or a tire.

The sound collection device 101 includes noise sounds corresponding to the detection values of various sensors as a database. For example, since the wind noise changes in accordance with the opening/closing degree of the window, the database includes noise sounds that correspond to the opening/closing degrees of the window. In addition, since the road noise changes in accordance with the tire rotational speed, the database includes noise sounds that correspond to the tire rotational speed. Alternatively, since the engine noise changes in accordance with the engine rotational speed, the database includes noise sounds that correspond to the engine rotational speed. The signal processing unit reads the noise sounds corresponding to the various sensor detection values and carries out the noise reduction process using the read noise sounds. As a result, the signal processing unit can perform the appropriate noise reduction process corresponding to the state of use of the automobile. As a result, the user can carry out a call comfortably with reduced noise using the hands-free phone.

In addition, the sound collection device 101 is not limited to the example in which it is built into the moving body 1. For example, the sound collection device 101 can be built into a helmet. Even if built into the helmet, the database of noise sounds corresponding to various sensor detection values is prepared, and the sound collection device reads the noise sound from the database to carry out the noise reduction process. For example, the sound collection device 101 reads the corresponding noise sound in accordance with the opening/closing degree of a visor, and carries out the noise reduction process using the read noise sound.

What is claimed is:

1. A sound collection device comprising:

a sensor configured to detect a state of at least one of the sound collection device or a device equipped with the sound collection device, or both as a detection object;

a microphone;

a database of noise sounds in which the noise sounds, which have been generated by the detection object to be detected by the sensor and acquired using the microphone in advance in a state in which only the noise sounds are acquirable by the microphone, are associated with detection values of the detection object to be detected, and recorded; and an electronic controller including a signal processing unit configured to read at least one noise sound from the database based on a detection value that the sensor detects, and carry out a noise reduction process to reduce noise from a sound signal acquired by the microphone based on the at least one noise sound read from the database.

2. The sound collection device according to claim 1, wherein the sensor includes a tachometer.

3. The sound collection device according to claim 2, wherein the at least one noise sound includes noise sound that is generated by the detection object of the tachometer.

4. The sound collection device according to claim 1, wherein the sensor includes a wind velocity sensor.

5. The sound collection device according to claim 1, wherein the sensor includes an orientation sensor.

6. The sound collection device according to claim 1, wherein the signal processing unit is configured to adjust a frequency gain based on a frequency characteristic of the at least one noise sound read from the database.

7. The sound collection device according to claim 1, wherein when a noise sound that matches the detection value of the sensor is not present in the database, the signal processing unit is configured to read the noise sound that is closest to the detection value among the noise sounds of the database.

8. The sound collection device according to claim 1, wherein when a noise sound that matches the detection value of the sensor is not present in the database, the signal processing unit is configured to read at least two noise sounds from the database, and obtain a noise sound to be used for the noise reduction process based on the at least two noise sounds.

9. The sound collection device according to claim 7, wherein the detection value includes at least one or more of rotational speed, angular velocity, angular acceleration, orientation, acceleration, or velocity.

10. The sound collection device according to claim 1, wherein the signal processing unit is further configured to transmit, via a wireless communicator of the device, a sound which is obtained by applying the noise reduction process to the sound signal acquired by the microphone based on the at least one noise sound read from the database.

11. A moving body comprising:

the sound collection device according to claim 1; and a rotating body, the sensor including a tachometer of the rotating body, and the at least one noise sound including a noise sound that is generated by the rotating body.

12. The moving body according to claim 11, wherein the rotating body includes a propeller.

13. The moving body according to claim 11, wherein the rotating body is an engine, a motor, or a tire of an automobile.

14. A sound collection method comprising:

acquiring in advance, by using a microphone, noise sounds generated by a detection object to be detected by a sensor in a state in which only the noise sounds are acquirable by the microphone, and recording the noise sounds in a database of the noise sounds such that the noise sounds are associated with detection values of the detection object to be detected;

detecting a state of at least one of a sound collection device or a device equipped with the sound collection device, or both;

reading at least one noise sound based on a detection value obtained by the detecting from the database of the noise sounds; and carrying out a noise reduction process to reduce noise from a sound signal acquired by the microphone based on the at least one noise sound read from the database.

15. The sound collection method according to claim 14, wherein the detecting includes detecting a rotational speed of a rotating body of the device by a tachometer.

16. The sound collection method according to claim 15, wherein the noise sound includes noise sound that is generated by the rotating body.

17. The sound collection method according to claim 14, wherein the detecting includes detecting a wind velocity by a wind velocity sensor.

18. The sound collection method according to claim 14, wherein the detecting includes detecting angular velocities of the at least one of the sound collection device or the device equipped with the sound collection device, or both by an orientation sensor.

19. The sound collection method according to claim 14, wherein the carrying out of the noise reduction process includes adjusting a frequency gain based on a frequency characteristic of the at least one noise sound read from the database.

20. The sound collection method according to claim 14, further comprising transmitting, via a wireless communicator of the device, a sound obtained by applying the noise reduction process to the sound signal acquired by the microphone based on the at least one noise sound read from the database.

21. A sound collection device comprising:

a sensor configured to detect a state of at least one of the sound collection device or a device equipped with the sound collection device, or both;

a database of noise sounds;

a microphone; and an electronic controller including a signal processing unit configured to read at least one noise sound corresponding to a detection value that the sensor detects from the database based on the detection value, and carry out a noise reduction process to reduce noise from a sound signal acquired by the microphone based on the at least one noise sound read from the database, thereby extracting a target sound, the signal processing unit being configured to carry out the noise reduction process by obtaining a noise spectrum based on a frequency characteristic of the at least one noise sound read from the database and adjusting a frequency gain of the sound signal obtained by the microphone, thereby extracting the target sound.

22. A sound collection method by using the sound collection device according to claim 21, the method comprising:

detecting, at the sensor, the state of the at least one of the sound collection device or the device equipped with the sound collection device, or both; and reading, at the signal processing unit, the at least one noise sound corresponding to the detection value from the database based on the detection value, and carrying out the noise reduction process, at the signal processing unit, to reduce the noise from the sound signal acquired by the microphone based on the at least one noise sound read from the database, thereby extracting the target sound, the carrying out of the noise reduction process being performed by obtaining the noise spectrum based on the frequency characteristic of the at least one noise sound read from the database and adjusting the frequency gain of the sound signal obtained by the microphone to extract the target sound.

* * * * *